US005655411A

United States Patent [19]

Avitan et al.

[11] Patent Number: 5,655,411

[45] Date of Patent: Aug. 12, 1997

[54] DUAL AXIS CARRIAGE ASSEMBLY FOR A CONTROL HANDLE

[75] Inventors: Isaac Avitan; Lev M. Bolotin, both of Sioux City, Iowa

[73] Assignee: Schaeff, Incorporation, Sioux City, Iowa

[21] Appl. No.: 546,612

[22] Filed: Oct. 23, 1995

[51] Int. Cl.[6] ..... G05G 9/047

[52] U.S. Cl. ..... 74/471 XY

[58] Field of Search ..... 74/471 XY, 469, 74/470, 471 R

[56] References Cited

U.S. PATENT DOCUMENTS

| | | | |
|---|---|---|---|
| D. 362,330 | 9/1995 | Avitan | D34/35 |
| 3,295,386 | 1/1967 | Menefee | 74/471 |
| 3,323,386 | 6/1967 | Musick | 74/471 |
| 3,707,093 | 12/1972 | Worden | 74/471 |
| 4,036,321 | 7/1977 | Habiger | 74/471 X |
| 4,148,014 | 4/1979 | Burson | 340/709 |
| 4,156,130 | 5/1979 | Ivashin | 235/92 |
| 4,350,055 | 9/1982 | Pinomäki | 74/471 X |
| 4,520,355 | 5/1985 | Mitch | 340/709 |
| 4,584,510 | 4/1986 | Hollow | 318/584 |
| 4,620,176 | 10/1986 | Hayes | 338/128 |
| 4,763,100 | 8/1988 | Wood | 338/128 |
| 4,920,820 | 5/1990 | Ingham et al. | 74/471 X |
| 5,140,313 | 8/1992 | Wen | 74/471 X |
| 5,286,024 | 2/1994 | Winblad | 273/434 |
| 5,503,040 | 4/1996 | Wright | 74/471 X |

*Primary Examiner*—Charles A. Marmor
*Assistant Examiner*—David M. Fenstermacher
*Attorney, Agent, or Firm*—Natter & Natter

[57] ABSTRACT

A dual axis carriage assembly for industrial control handles includes a base yoke fixed to a support surface and a moveable yoke to which the control handle is attached. Each yoke includes a pair of coaxial spaced bearing surfaces and journal portions of one shaft of a cross shaft assembly are received in the bearing surfaces of the moveable yoke while journal portions of the other shaft are received in the bearing surfaces of the base yoke. A torsion coil spring is carried on each shaft with the spring having a pair of parallel arms which straddle the sides of a flange projecting from the yoke within which the corresponding shaft is received. A dog, fixed to the end of each shaft includes an axial leg which is positioned between the spring arms. Rotation of each shaft relative to its yoke results in displacement of one spring arm so that the spring returns the shaft to a null position. The dog also includes two radial legs which engage the yoke flange to provide rotation limit stops. An angular displacement transducer and includes a body fixed to each yoke and a stem which is received in an axial bore of the corresponding shaft to generate a signal representative of angular displacement of each shaft with respect to a reference position.

17 Claims, 4 Drawing Sheets

DUAL AXIS CARRIAGE ASSEMBLY FOR A CONTROL HANDLE

BACKGROUND OF THE INVENTION

1. Field of the Invention

This invention relates generally to vehicle control systems and more particularly to a dual axis carriage assembly for a control handle employed in the operation of industrial load handling equipment.

2. Related History

Industrial load handling equipment such as fork lifts and the like, required precise and exact control systems for safety and efficiency. Equipment of this type often operated in tight quarters such as between isles in high bay storage racks and also inside semi-trailers. Further, the weight of a typical electric motor driven lift truck with batteries ranged from between 9,000 pounds unloaded to 16,000 loaded. The direction of travel, speed, load position, tilt angle and load engagement, as controlled by a vehicle operator, were crucial safety and operational parameters.

Many operator control functions were integrated into a single control handle wherein the pivotal movement of the handle about one axis controlled vehicle travel direction and speed, for example, while the movement of the handle about a transverse axis controlled a different function, such as the elevation of lift forks.

It was also desireable to have both axes of control movement intersect at a single pivot point and to have control signals generated as a direct function of the angular position of the handle along both axes.

While x-y movement control systems such as joy sticks have been heretofore incorporated in applications such as personal computers and games, the implementation of joy stick type controls in an industrial work place environment, such as the operating floor of a plant or warehouse, by hourly laborers, rather than engineers or technicians, presented unique challenges.

For example, an operator riding with and controlling a fork lift would often resort to excessive force and sudden control handle movements, which was compounded by the fact that the operators frequently wore work gloves. Joy stick controls did not have the structural durability to withstand the shock and control forces generated by such applications.

SUMMARY OF THE INVENTION

A dual axis carriage assembly for a control handle includes a base yoke which is fixed relative to a support surface and a moveable yoke to which the control handle is attached. Each yoke carries a pair of spaced pillow blocks. A cross shaft assembly includes a pair of coplanar shafts which intersect perpendicular to one another. Each shaft includes journal portions received in one of the pillow blocks such that the control handle may be pivoted about a point comprising the intersection of the shaft axes.

Each shaft includes a tail portion which projects beyond a pillow block and carries a torsion coil spring. The spring includes a pair of parallel arms which straddle sides of a flange projecting from one of the yokes in registration with the shaft.

A dog is fixed to the tail end of each shaft. A central axial leg of the dog is positioned between the arms of the spring so that rotation of the shaft in either direction will result in displacement of a spring arm. The spring thus serves to return the shaft to a null position.

Two radial legs of the dog function as stops, engaging the flange to limit rotation of the shaft in either direction.

The opposite end of each shaft includes an axial socket within which a potentiometer wiper stem is received. The body of the potentiometer is fixed relative to its associated yoke so that the output of each potentiometer comprises a signal representative of the angular displacement of the control handle relative to the corresponding shaft axis.

From the foregoing compendium, it will be appreciated that it is an aspect of the present invention to provide a dual axis carriage assembly for a control handle of the general character described which is not subject to the disadvantages of the background art aforementioned.

It is a feature of the present invention to provide a dual axis carriage assembly for a control handle of the general character described which is well suited to meet the rigors encountered in industrial use applications.

A consideration of the present invention is to provide a dual axis carriage assembly for a control handle of the general character described which is rugged in construction, yet capable of generating precise control signals.

A further aspect of the present invention is to provide a dual axis carriage assembly for a control handle of the general character described wherein a transducer is positioned coaxial with each of a pair of transverse rotational axes to generate signals representative of the angular orientation of a control handle about each of the pair of axes.

Another feature of the present invention is to provide a dual axis carriage assembly for a control handle of the general character described which incorporates a fail safe system for return of the control handle to a null position in the absence of a control force applied by an operator.

Another consideration of the present invention is to provide a dual axis carriage assembly for a control handle of the general character described which is relatively low in cost and well suited for economical mass production fabrication.

To provide a dual axis carriage assembly for a control handle of the general character described which is capable of withstanding repeated shocks generated in an industrial work area is a further aspect of the present invention.

Yet another consideration of the present invention is to provide a dual axis carriage assembly for a control handle of the general character described which is particularly well suited for lift truck control applications.

An additional feature of the present invention is to provide a dual axis carriage assembly for a control handle of the general character described which is easily serviceable as a single unit for replacement or for repair or replacement of individual components thereof.

To furnish a dual axis carriage assembly for a control handle of the general character described which is particularly well suited for implementation with conventional angular orientation transducers is yet another aspect of the present invention.

Still another feature of the present invention is to provide a dual axis carriage assembly for a control handle of the general character described which is adapted for the employment of return springs having different spring constants to apprise an operator of the control function effected by a particular direction of movement as a function of the resistance force encountered.

Other aspects, features and considerations of the present invention in part will be obvious and in part will be pointed out hereinafter.

With these ends in view, the invention finds embodiment in certain combinations of elements, arrangements of parts and series of steps by which the said aspects, features and considerations and certain other aspects, features and considerations are attained, all with reference to the accompanying drawings and the scope of which will be more particularly pointed out and indicated in the appended claims.

BRIEF DESCRIPTION OF THE DRAWINGS

In the accompanying drawings, in which is shown one of the various possible exemplary embodiments of the invention.

DESCRIPTION OF THE PREFERRED EMBODIMENT

Figure 1:
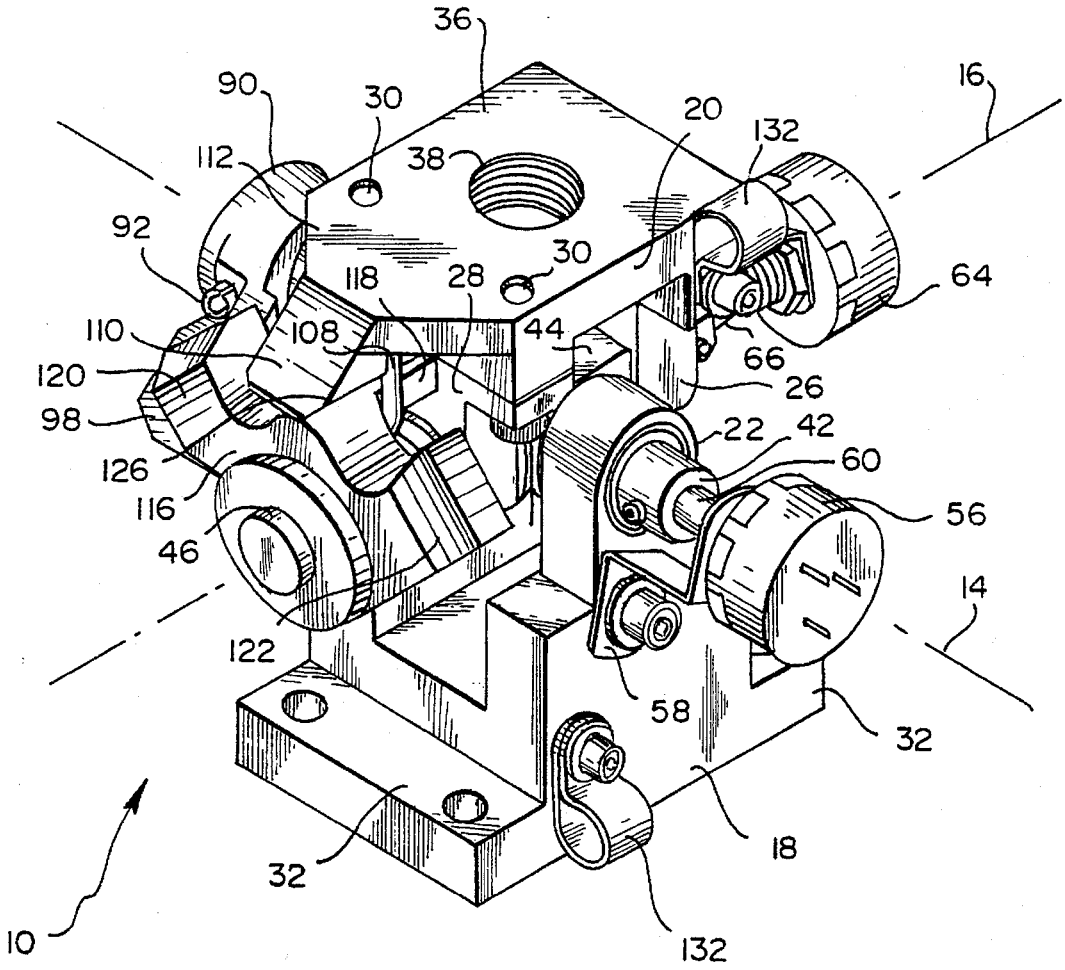
FIG. 1 is a perspective illustration of a carriage assembly constructed in accordance with and embodying the invention and showing a base yoke and a moveable yoke, a cross shaft assembly and a potentiometer carried on each of the yokes for measurement of the angular displacement of a control handle which is to be mounted to the moveable yoke.

Referring now in detail to the drawings, the reference numeral 10 denotes generally a dual axis carriage assembly for a control handle constructed in accordance with and embodying the invention. The carriage assembly 10 is configured for supporting a multifunction control handle 12 for pivotal movement about the intersection point of a pair of transverse axes comprising an X axis, denoted generally by the reference numeral 14 and a Y axis, denoted generally by the reference numeral 16.

Figure 2:
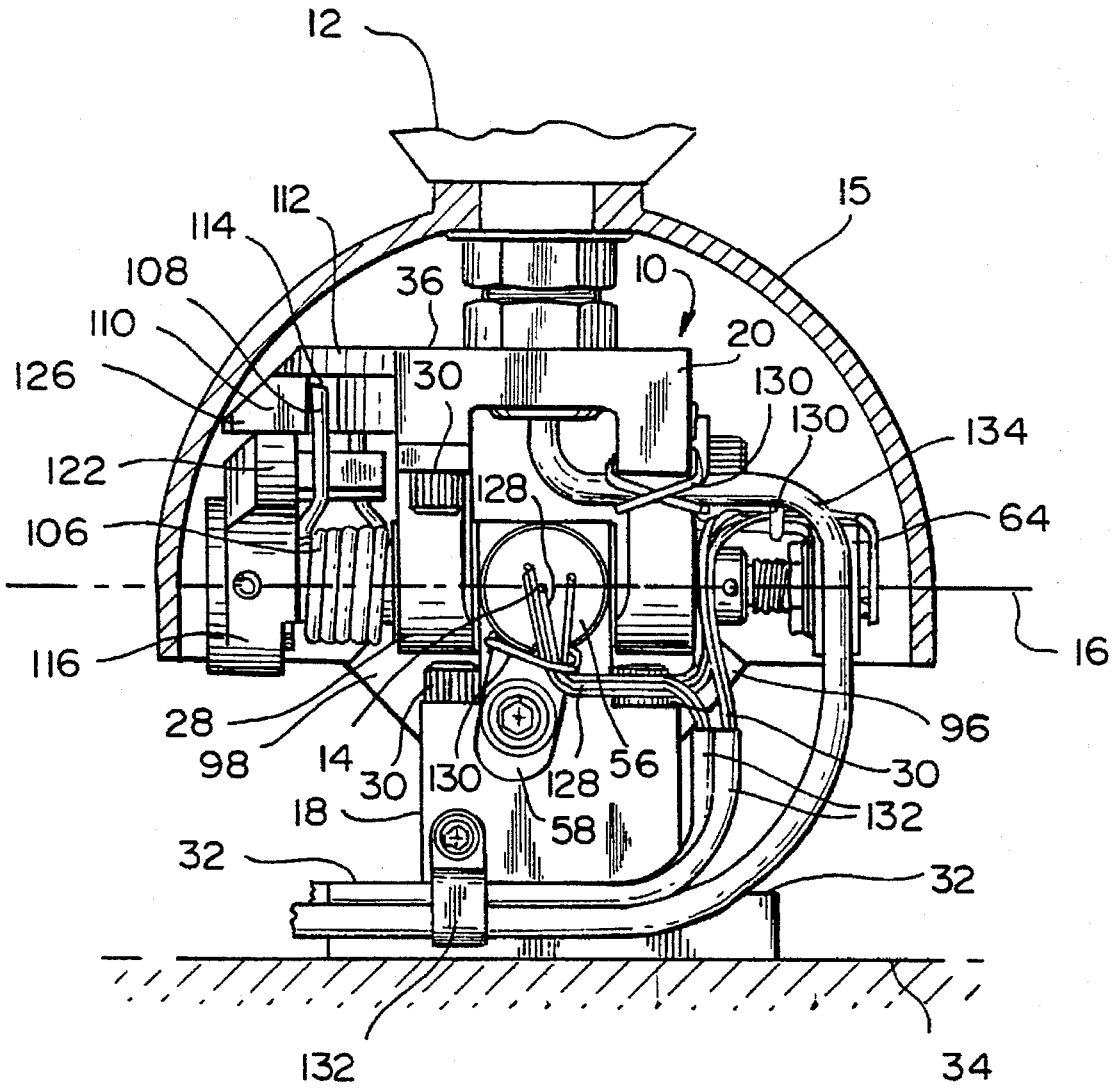
FIG. 2 is a front elevational view of the carriage assembly and showing a fragmentary portion of the control handle and in section, a boot which depends from the handle and covers the carriage assembly.

Illustrated in FIG. 2 is a flexible hemispherical boot 15 which depends from the control handle 12 and provides a cover for the carriage assembly 10. It should be noted that the control handle 12 may comprise any of a number of multifunction industrial type control handles such as the control handle depicted in U.S. Pat. No. Des. 362,330, issued to the assignee of the present invention.

The carriage assembly comprises a generally "U" shaped base yoke 18 interconnected with a moveable yoke 20 in the shape of an inverted "U". The base yoke 18 includes an integral upright bearing pillow block 22 extending from a longitudinal side edge and a separate bearing pillow block 24. Similarly, the moveable yoke 20 includes an integral bearing pillow block 26 and a separate bearing pillow block 28. The pillow blocks 24, 28 are secured to their respective yokes 18, 20, by cap screws 30 which extend through apertures formed in lateral base bosses of each pillow block into threaded apertures of the respective yokes so that each yoke, 18, 20 includes a pair of spaced bearing pillow blocks lying parallel to one another.

The base yoke 18 includes a pair of mounting flanges 32 having apertures for attaching the carriage assembly to a suitable support surface 34 (FIG. 2) which is fixed in respect to, for example, a vehicle frame. The moveable yoke 20 includes an upper planar platen 36 having a threaded aperture 38 for mounting the control handle 12.

Figure 3:
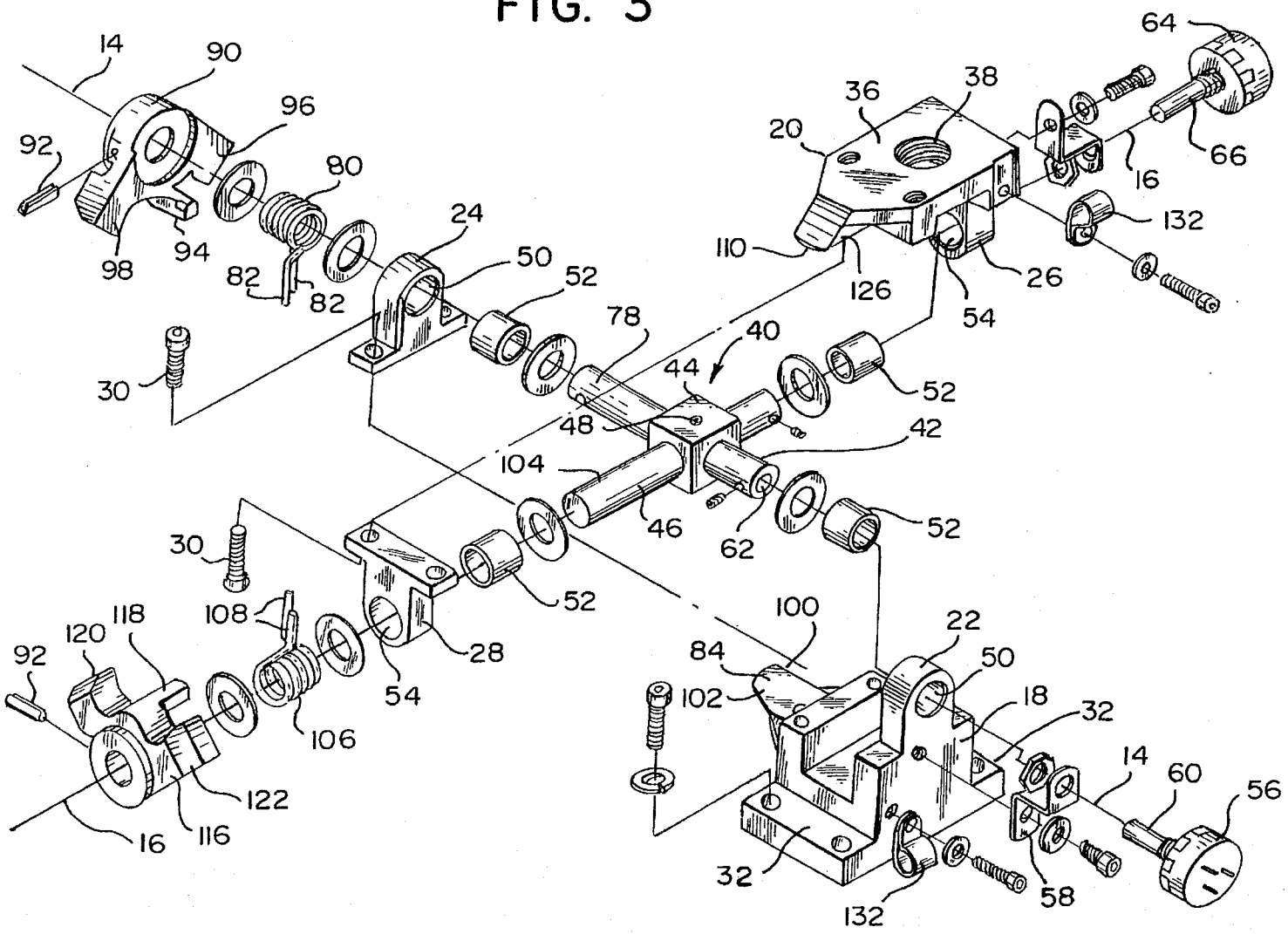
FIG. 3 is a reduced scale exploded perspective view of the carriage assembly and showing a cross shaft assembly and the manner in which journal portions of the shafts are carried in pillow blocks of the yokes.
Figure 4:
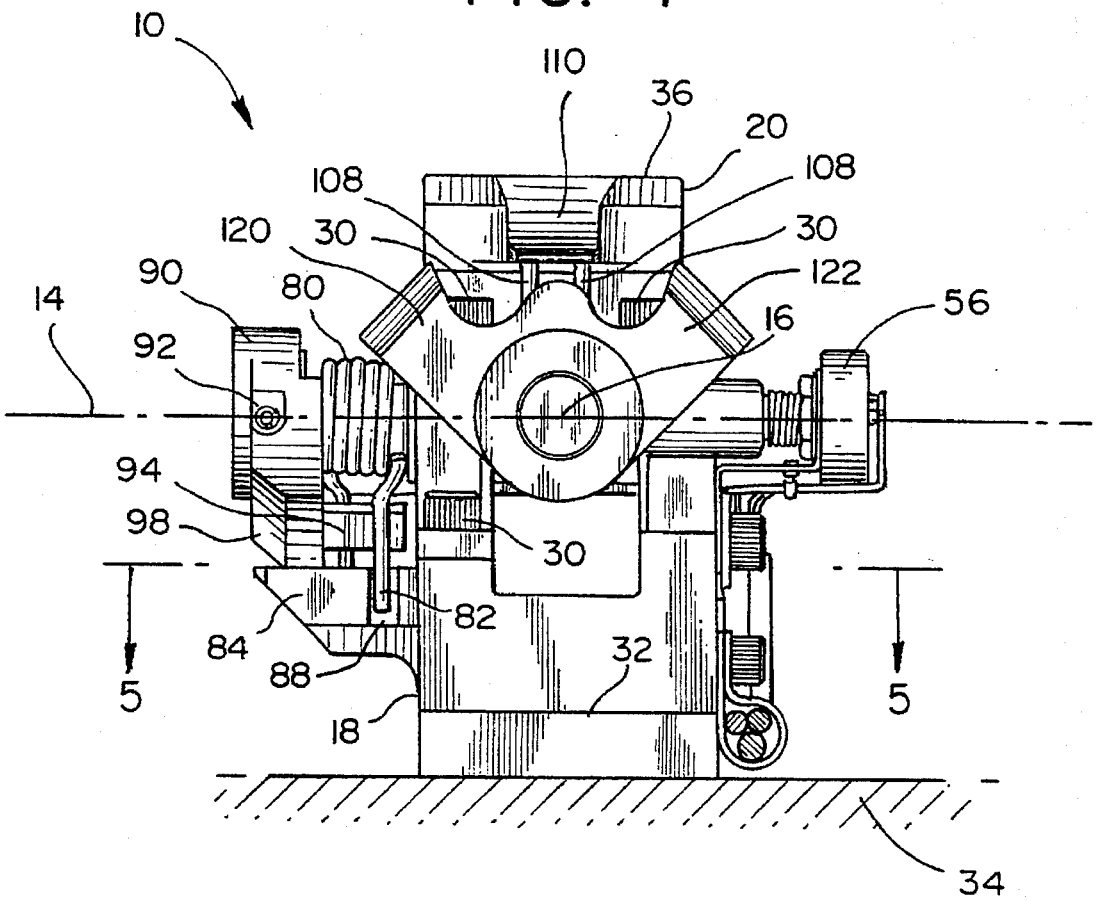
FIG. 4 is a side elevational view of the carriage assembly and illustrating a dog fixed to a tail end of each shaft for limiting the rotation of the moveable yoke about each respective axis and also showing a torsion coil spring for returning the yoke to a null position.
Figure 5:
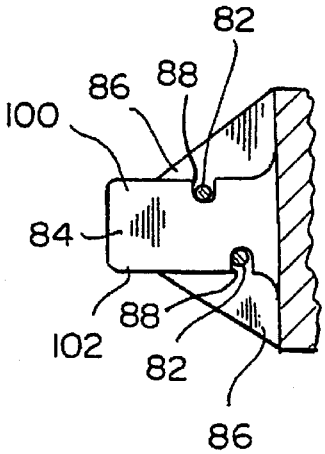
FIG. 5 is a fragmentary auxiliary sectional view through the base yoke the same being taken along the line 5—5 of FIG. 4 and showing a flange which is engaged by radial legs of the dog and grooved seats, each of which carries an arm of the spring.

Interconnecting the base yoke 18 and the moveable yoke 20 is a cross shaft assembly 40, best illustrated in FIG. 3. The cross shaft assembly 40 includes a generally cylindrical X axis shaft 42, formed of one piece with an integral union block 44. The union block 44 includes a transverse hollow bore within which a Y axis shaft 46 is seated. The Y axis shaft 46 is retained by conventional means, such as a set screw 48, extending through the block 44.

The base yoke pillow blocks 22, 24 each include a coaxial bore 50 within which a bushing 52 is seated. Journal portions of the shaft 42 are received within the pillow block bearing surfaces thus formed. As will be noted from an examination of FIG. 3, spacer washers may be positioned on the shaft 42 between the pillow blocks 22, 24 and the union block 44.

Similarly, coaxial bores 54 are formed in the bearing pillow blocks 26, 28 of the moveable yoke 20 and a bushing 52 is received within each pillow block bore 54 to provide bearing surfaces for journal portions of the Y axis shaft 46.

With the yokes 18, 20 thus interconnected through the cross shaft assembly 40, the moveable yoke 20 may be rotated about the X axis 14 with journal portions of the shaft 42 rotating in the bearing surfaces of the pillow blocks 22, 24 and simultaneously rotated about the Y axis 16, with journal portions of the Y axis shaft 46 rotating within the bearing surfaces of the pillow blocks 26, 28. Movement of the moveable yoke 20 is to be effected by pivotal movement of the control handle 12 about a common center point comprising the intersection of the axes 14, 16.

An angular position transducer or sensor such as a potentiometer 56 is provided to generate a signal representative of the instantaneous angular displacement of the control handle 12 about the X axis 14. The potentiometer 56 is of conventional configuration and includes a body which is fixed relative to the base yoke 18 by a bracket 58 and nut in a position wherein a stem 60 of the potentiometer is coaxial with the X axis 14 and is received within a hollow coaxial socket 62 formed in an end of the shaft 42. The stem 60 is fixed to the shaft 42 by a set screw. Thus, the angular displacement of the moveable yoke about the X axis causes congruent angular displacement of a wiper of the potentiometer 56 which generates a signal representative of such angular displacement.

Similarly, the angular displacement of the Y axis shaft 46 is sensed by a potentiometer 64, the body of which is mounted on and fixed relative to the moveable yoke pillow block 26 by a similar bracket arrangement. A stem 66 of the potentiometer 64 is received within a coaxial socket formed in an end of the shaft 46 such that the angular displacement of the moveable yoke 20 about the Y axis 16 is sensed by the potentiometer 64 which generates a signal representative thereof.

A tail portion of the X axis shaft 48 extends beyond the pillow block 24. The tail portion 78 carries a coil torsion spring 80 having a pair of spaced substantially parallel arms 82. The arms 82 abut a flange 84 which projects from the side of the base yoke to which the pillow block 24 is mounted which flange 84 is registered with the tail portion 78. A reinforcing gusset 86 extends laterally from beneath the flange 84 to the side of the base yoke 18.

The flange 84 includes a pair of opposed axially offset notched seats 88 each of which receives an arm 82 when the moveable yoke is not angularly displaced along the X axis 14.

A dog 90 having a cylindrical bore is fixed to the tail end of the shaft 42 by conventional means, such as a pin 92 which extends through a transverse bore in the shaft 42 and in the dog 90. The dog includes an axial leg 94 having a width substantially the same as the distance between the offset flange seats 88.

Rotation of the moveable yoke about the X axis in either a clockwise or counterclockwise direction will stress the spring 80 since such rotation will cause the dog leg 94 to engage one of the spring arms 82 and deflect such spring arm. The spring 80 thus serves to provide a resistance force against displacement of the moveable yoke about the X axis and will return the moveable yoke to a null position, relative to the X axis, when there is no operator control force having an X axis vector component applied to the control handle 12.

In addition to the axial leg 94, the dog 90 includes a pair of radial legs 96, 98. Rotation of the moveable yoke about the X axis in a clockwise direction, as viewed in PIG. 3, will be limited by engagement of the radial leg 96 against an abutment portion 100 of the flange 94. Similarly, counterclockwise rotation of the moveable yoke about the X axis will be limited by engagement of the radial leg 98 against an abutment portion 102 of the flange 94.

Similarly, a tail portion 104 of the shaft 46 which projects beyond the pillow block 28 carries a torsion coil spring 106 having a pair of parallel arms 108. The arms 108 engage a flange 110 which extends axially from the moveable yoke adjacent the pillow block 28. A pair of opposed, axially offset seats 114 are provided on opposite sides of the flange 110 for receiving the spring arms 108. The flange 110 is reinforced, in a manner similar to the reinforcement of the flange 84, by a gusset 112.

A dog 116, similar to the dog 90, is fixed to the tail end of the shaft 46, as by a pin 92 and includes an axial leg 118 which projects toward the pillow block 28. The leg 118 is straddled by the spring arms 108 and rotation of the moveable yoke about the Y axis will cause engagement between the arm 118 and either of the spring arms 108. Accordingly, the spring 106 functions to return the moveable yoke to a null position of zero rotational displacement about the Y axis.

The dog 116 also includes a pair of radial legs, 120, 122 which serve to limit rotation of the moveable yoke about the Y axis by engagement against corresponding abutment portions 124, 126, respectively of the flange 110.

In accordance with the invention, in a lift truck application wherein movement of the control handle 12 about the X axis may, for example, effect raising and lowering of the vehicle forks while movement of the control handle about the Y axis controls direction and speed of vehicle travel, it is desireable to provide the X axis spring 80 with a spring constant greater than the spring constant of the Y axis spring 106. As such, an operator becomes familiar with the function attributable to each direction of control handle movement as a result of the difference in resistance force encountered.

With attention now directed to FIG. 2 wherein a fully assembled dual axis carriage assembly is depicted, it should be noted that electrical leads 128 extend from contact pins of the potentiometers 56, 64. Wire ties 130 may be employed to position the leads 128 which are carried in sheaths 132 and are maintained in position by brackets 132. Additionally, leads extending from auxiliary control sensors and switches carried in the handle 12 may extend through the handle 12, and a stem mounting collar which is engaged in the aperture 38, and through the moveable yoke in a further sheath 134.

It should be appreciated that the carriage assembly of the present invention is .sturdily fabricated and well suited to withstand the rigors encountered in industrial usage. The yokes and pillow blocks may be formed of relatively light weight yet durable metal, such as an aluminum alloy as may be the dogs. The shafts 42, 46 which form the cross shaft assembly 40 may be fabricated of steel, by way of example.

Thus it will be seen that there is provided a dual axis assembly for a control handle which achieves the various aspects, features and considerations of the present invention and which is well suited to meet the conditions of practical usage.

While various modifications and changes might be made in the invention above set forth without departing from the spirit of the invention, it is to be understood that all matter herein described or shown in the accompanying drawings is to be interpreted as illustrative and not in a limiting sense.

Having thus described the invention, there is claimed as new and desired to be secured by Letters Patent:

1. A dual axis carriage assembly for a control handle, the assembly comprising: a first yoke, the first yoke including a pair of spaced pillow blocks, the pillow blocks of the first yoke having coaxial bearing surfaces, a second yoke, the second yoke including a pair of spaced pillow blocks, the pillow blocks of the second yoke having coaxial bearing surfaces, a cross shaft assembly, the cross shaft assembly including a first shaft having a first shaft axis and a second shaft having a second shaft axis, the second shaft being perpendicular to and intersecting the first shaft, means for journaling the first shaft within the coaxial bearing surfaces of the first yoke for movement of the first yoke relative to the first shaft from a first shaft angular reference position, means for journaling the second shaft within the coaxial bearing surfaces of the second yoke for movement of the second shaft, the first shaft and the first yoke about the axis of the second shaft and relative to the second yoke from a second shaft angular reference position, the second yoke being adapted for attachment to a support surface and the first yoke being adapted for attachment of the control handle, the carriage assembly further comprising first transducer means for detecting the angular displacement of the first yoke about the first shaft relative to the first shaft reference position, second transducer means for determining the angular displacement of the second shaft about the second yoke, relative to the second shaft reference position, first biasing means for returning the first yoke to the first shaft reference position, the first biasing means comprising first coil spring means carried on the first shaft, first flange means fixed relative to the first yoke, first engagement means fixed to the first shaft for deflecting the first spring means in response to displacement of the first yoke relative to the first shaft reference position, the flange means including means for restraining at least a portion of the first spring means against deflection by the first engagement means and second biasing means for returning the second shaft to the second shaft reference position, first shaft stop means for limiting the angular displacement of the first yoke about the first shaft and second shaft stop means for limiting the angular displacement of the second shaft relative to the second yoke.

2. A dual axis carriage assembly for a control handle as constructed in accordance with claim 1 wherein the first transducer means comprises rotatable means and a body, the rotatable means being displaceable relative to the body, means coaxially connecting the first transducer rotatable means to the first shaft for rotation with the first shaft and means fixing the first transducer body relative to the first yoke, the second transducer means comprising second transducer rotatable means and a second transducer body, the second transducer rotatable means being displaceable relative to the second transducer body, means coaxially connecting the second transducer rotatable means to the second shaft for rotation with the second shaft and means fixing the second transducer body relative to the second yoke.

3. A dual axis carriage assembly for a control handle as constructed in accordance with claim 2 wherein the first and second transducer means each comprises a potentiometer, each rotatable means comprising a stem, each means connecting each rotatable means to its respective shaft comprising a coaxial socket in each shaft, each stem being received in the socket of its respective shaft.

4. A dual axis carriage assembly for a control handle as constructed in accordance with claim 1 wherein the first flange means extends in a direction parallel to the axis of the first shaft and the first engagement means extends in a direction parallel to the axis of the first shaft, the first engagement means and the first flange means lying within a common plane when the first yoke is in the first shaft reference position, the means for restraining at least a portion of the first spring means being axially spaced from the engagement between the engagement means and the spring means.

5. A dual axis carriage assembly for a control handle as constructed in accordance with claim 1 wherein the second biasing means comprises second coil spring means carried on the second shaft, second flange means fixed relative to the second yoke, second engagement means fixed to the second shaft for deflecting the second spring means in response to displacement of the second shaft relative to the second shaft reference position, the second flange means including means for restraining at least a portion of the second spring means against deflection by the second engagement means.

6. A dual axis carriage assembly for a control handle as constructed in accordance with claim 5 wherein the second shaft includes a portion projecting beyond one of the second yoke pillow blocks, the second coil spring means being carried on the projecting portion of the second shaft.

7. A dual axis carriage assembly for a control handle as constructed in accordance with claim 6 further including first dog means fixed to the first shaft on the projecting portion thereof and second dog means fixed to the second shaft on the projecting portion thereof, the first shaft stop means comprising a radial leg projecting from the first dog means and abutment means fixed to the first yoke for engagement by the leg of the first dog, the second shaft stop means comprising a radial leg projecting from the second dog means and abutment means fixed to the second yoke for engagement by the leg of the second dog.

8. A dual axis carriage assembly for a control handle as constructed in accordance with claim 5 wherein the second coil spring means is configured with a pair of arms, each arm being in contact with the second flange means when the second shaft is at the second shaft reference position, the second engagement means deflecting one of the arms when the second shaft is displaced in one rotation direction and deflecting the other arm when the second shaft is displaced in the opposite rotation direction, the second shaft including a portion projecting beyond one of the second yoke pillow blocks, the second coil spring means being carried on the projecting portion of the second shaft.

9. A dual axis carriage assembly for a control handle as constructed in accordance with claim 1 wherein the first coil spring means is configured with a first arm and a second arm, each arm being in contact with the first flange means when the first yoke is at the first shaft reference position, the first engagement means deflecting the first arm when the yoke is displaced in one rotation direction and deflecting the second arm when the yoke is displaced in the opposite rotation direction.

10. A dual axis carriage assembly for a control handle as constructed in accordance with claim 9 wherein the first shaft includes a portion projecting beyond one of the pillow blocks of the first yoke, the first coil spring means being carried on the projecting portion of the first shaft.

11. A dual axis carriage assembly for a control handle as constructed in accordance with claim 1 wherein the first shaft includes a portion projecting beyond one of the pillow blocks of the first yoke, the first coil spring means being carried on the projecting portion of the first shaft.

12. A dual axis carriage assembly for a control handle, the assembly comprising: a first yoke, the first yoke including a pair of spaced pillow blocks, the pillow blocks of the first yoke having coaxial bearing surfaces, a second yoke, the second yoke including a pair of spaced pillow blocks, the pillow blocks of the second yoke having coaxial bearing surfaces, a cross shaft assembly, the cross shaft assembly including a first shaft having a first shaft axis and a second shaft having a second shaft axis, the second shaft being perpendicular to and intersecting the first shaft, means for journaling the first shaft within the coaxial bearing surfaces of the first yoke for movement of the first yoke relative to the first shaft from a first shaft angular reference position, means for journaling the second shaft within the coaxial bearing surfaces of the second yoke for movement of the second shaft, the first shaft and the first yoke about the axis of the second shaft and relative to the second yoke from a second shaft angular reference position, the second yoke being adapted for attachment to a support surface and the first yoke being adapted for attachment of the control handle, the carriage assembly further comprising first transducer means for detecting the angular displacement of the first yoke about the first shaft relative to the first shaft reference position, second transducer means for determining the angular displacement of the second shaft about the second yoke, relative to the second shaft reference position, first biasing means for returning the first yoke to the first shaft reference position and second biasing means for returning the second shaft to the second shaft reference position, first shaft stop means for limiting the angular displacement of the first yoke about the first shaft and second shaft stop means for limiting the angular displacement of the second shaft relative to the second yoke, the carriage assembly further including a first dog means fixed to the first shaft adjacent one end thereof and a second dog means fixed to the second shaft adjacent one end of the second shaft, the first shaft stop means comprising a radial leg projecting from the first dog means and abutment means fixed to the first yoke for engagement by the leg of the first dog means, the second shaft stop means comprising a radial leg projecting from the second dog means and abutment means fixed to the second yoke for engagement by the leg of the second dog means.

13. A dual axis carriage assembly for a control handle as constructed in accordance with claim 12 wherein the first dog means includes a second radial leg, the first yoke including second abutment means for engagement by the second radial leg of the first dog means.

14. A dual axis carriage assembly for a control handle as constructed in accordance with claim 12 wherein the first biasing means comprises first coil spring means carried on the first shaft, first flange means fixed relative to the first yoke, engagement means fixed to the first shaft for deflecting and biasing the first spring means in response to displacement of the first yoke relative to the first shaft reference position, the engagement means projecting axially from the first dog, the flange means including means for restraining at least a portion of the first spring means against deflection by the engagement means.

15. A dual axis carriage assembly for tilting movement of a control handle about a pivot point, the assembly comprising a first yoke, a first shaft having an axis, the first shaft including journal portions carried in the first yoke, a second yoke, a second shaft having an axis, the second shaft including journal portions carried in the second yoke, means for fixing the second yoke relative to a support surface, the first shaft axis and the second shaft axis being perpendicular, lying in a common plane and intersecting one another at an intersection point, the intersection point comprising the control handle pivot point, means for mounting the control handle to the first yoke, the first yoke being rotatable about the first shaft axis and pivotable about the second shaft axis, the second yoke and the second shaft including second shaft limits top means, the second shaft limit stop means comprising a second shaft dog having a pair of radial arms, means fixing the second shaft dog to the second shaft adjacent an end of the second shaft and abutment means carried by the second yoke, the second yoke abutment means being engaged by the radial arms of the second shaft dog to limit rotation of the second shaft relative to the second yoke.

16. A dual axis carriage assembly for tilting movement of a control handle about a pivot point as constructed in accordance with claim 15 further including first transducer means for detecting the angular displacement of the first yoke about the first shaft relative to a first shaft reference position and second transducer means for detecting the angular displacement of the second shaft about the second yoke relative to a second shaft reference position.

17. A dual axis carriage assembly for tilting movement of a control handle about a pivot point as constructed in accordance with claim 15, the first yoke and the first shaft including first shaft limit stop means, the first shaft limit stop means comprising a first shaft dog, the first shaft dog being fixed adjacent an end of the first shaft, the dog including a pair of radial arms, the first yoke including abutment means, the radial arms contacting the first yoke abutment means to limit rotation of the first yoke relative to the first shaft.

* * * * *